United States Patent [19]

Liebelt

[11] Patent Number: 4,770,360

[45] Date of Patent: Sep. 13, 1988

[54] WINDING MACHINE

[75] Inventor: Julius Liebelt, Wiehl, Fed. Rep. of Germany

[73] Assignee: Kampf GmbH & Co. Maschinenfabrik, Fed. Rep. of Germany

[21] Appl. No.: 25,734

[22] Filed: Mar. 13, 1987

[30] Foreign Application Priority Data

Mar. 15, 1986 [DE] Fed. Rep. of Germany ..... 3608779

[51] Int. Cl.[4] ..... B65H 19/04

[52] U.S. Cl. ..... 242/56.9; 242/68.4

[58] Field of Search ..... 242/68.4, 56.9, 56.2

[56] References Cited

U.S. PATENT DOCUMENTS

| | | | |
|---|---|---|---|
| 767,193 | 8/1904 | Witham | 242/56.9 |
| 1,059,503 | 4/1913 | Stuart | 242/68.4 |
| 1,986,053 | 1/1935 | Friess | 242/56.9 X |
| 3,057,571 | 10/1962 | Aaron | 242/68.4 X |
| 4,102,511 | 7/1978 | Krimsky | 242/68.4 X |
| 4,497,455 | 2/1985 | Kampf et al. | 242/56.9 |

FOREIGN PATENT DOCUMENTS

| | | |
|---|---|---|
| 097730 | 1/1987 | European Pat. Off. . |
| 3215204 | 11/1983 | Fed. Rep. of Germany . |
| 870716 | 6/1961 | United Kingdom . |
| 1560742 | 2/1980 | United Kingdom . |

*Primary Examiner*—Stanley N. Gilreath
*Assistant Examiner*—Katherine Matecki
*Attorney, Agent, or Firm*—Bacon & Thomas

[57] ABSTRACT

A winding machine with a swivelling cross-beam, with pairs of winding arms, movable on guidewalls of the cross-beam and receiving one roll for each pair, as well as with drive shafts, aligned in parallel with the swivelling axis of the cross-beam, from which drive shafts the winding drive is taken for a plurality of rolls. In parallel with the cross-beam a number of drive shafts, corresponding to the number of pairs of winding arms, is arranged. In each case one drive shaft within a pair of winding arms is coupled in a form-locking manner with the winding drive unit of the roll. On, at least, one end of the cross-beam the driving motors are arranged according to the number of the drive shafts.

9 Claims, 3 Drawing Sheets

WINDING MACHINE

BACKGROUND OF THE INVENTION

1. FIELD OF THE INVENTION

The invention relates to a winding machine with a swivelling T-shaped cross-beam, with pairs of winding arms, movable on guideways of the cross-beam and receiving one roll each, as well as with a drive shaft, aligned in parallel with the swivelling axis of the cross-beam, from which drive shaft the winding drive is taken for a plurality of rolls.

2. DESCRIPTION OF THE PRIOR ART

A winding-on machine of the said type is known from the DE-PS No. 32 15 204. Therein one drive shaft extends through the entire length of the cross-beam. The drive shaft drives one frictional wheel within each winding arm. The winding drive is taken in each case from the frictional wheel. Such a friction drive is limited in regard to its capability and efficiency due to the fact that it is not possible to transmit a high power, due to the temperature rise and the wear.

A rewinding machine having an individual drive for the individual winding arms is described in the EP-B1-0 097 730. Therein it is possible to equip each pair of winding arms with driving motors. It is possible to attach up to four driving motors to each pair of winding arms so that a graduation of the driving power is possible within a wide range. However, in the case of particularly thick foils a limit is reached due to the fact that it is not possible to provide the necessary capacity even by four driving motors. On the other hand, limitations result in the case of very narrow windings, because in such a case there is not sufficient space for the arrangement of the individual motors.

Utilization of hydraulic motors for the individual winding drives is also known. In such a case the insufficient adjustability of the hydraulic motors results in difficulties. In addition, leakage of the hydraulic liquid may lead to an unwholesome contamination of the material to be wound.

Thus, for all drive systems described difficulties result at high winding speeds and thick foils, because in such a case a high power demand exists, as well as, on the other hand, in the case of narrow windings for reasons of space.

SUMMARY OF THE INVENTION

One object of the invention is to provide a drive for a winding machine of the type as described above, where any limits of capacity or any limits of space do not occur for the individual drive unit.

This object is solved in that in parallel with a T-shaped cross-beam a number of drive shafts, corresponding to the number of pairs of winding arms supporting a roll, are arranged, that in each case one drive shaft within a pair of winding arms is coupled in a form-locking manner with the winding drive unit which drives the roll, and than on, at least, one end of the cross-beam, driving motors are arranged according to the number of the drive shafts.

The invention differs from the prior art in that for each pair of winding arms a separate drive shaft is provided. In the area of movement of the winding arms no driving motors are provided. On the cross-beam a plurality of drive shafts are provided in accordance with the number of the pairs of winding arms. The driving motors are provided adjacent an end of the cross-beam in a fixed relationship longitudinally relative to the cross-beam. One driving motor each is coupled with one drive shaft. In this manner it is possible to supply any power desired into the individual drive shafts and from there to the driving wheel which in turn drives the roll of the associated pair of winding arms, due to the fact that the size of the driving motors is practically unlimited so that thick material can be wound without any difficulties. In addition, an individual adjustment of the winding arms associated with an individual drive shaft is possible. The arrangement of the pairs of winding arms is determined merely by the structure of the winding arms. Consequently it is also possible to provide a minimum distance between the winding arms for extremely narrow windings and coils.

In order that the size of the driving motors is not determined by the small distance between axes of the drive shafts, the driving motors each are coupled via a gear unit with the associated drive shaft. Thereby it is possible to maintain for the drive shafts an extraordinarily small distance between axes. The driving motors themselves may be arranged according to their specific space requirements.

A particularly favourable arrangement for the driving motors is effected in that the driving motors are arranged in a rectangular configuration with their axes parallel with the drive shafts.

A favourable arrangement is secured in that the driving motors are permitted to swivel with the cross-beam.

The displaceability of the winding arms across the entire working length of the cross-beam and in permanent engagement with their associated drive shaft is reached in that each drive shaft is provided as an exterior splined shaft, and that within each winding arm a driving wheel with an interior splined passage engages the associated exterior splined shaft. This driving wheel imparts drive to a roll, rotatably mounted on the pair of winding arms.

In order to stabilize the comparatively thin and long drive shafts, it is provided that within each winding arm the drive shafts, not coupled positively to a driving wheel, are rotatably supported by the pairs of winding arms by bearings rotatably fixed to the drive shafts.

A close placing together of the winding arms of a pair for narrow windings is rendered possible in that four guideways are arranged on the cross-beam, and that each winding arm of a pair comprises two feet, the feet of one winding arm are staggered in regard to the feet of the other winding arm of the pair. The feet engage each other in a meshing manner, each pair of feet being guided on two guideways.

A reproducible adjustment of the carriages bearing the winding arms is secured in that feed rods, extending over the entire length of the cross-beam, are provided with a rack tooth profile, and that within each winding arm a toothed wheel engages the specific rack tooth profile.

The securing of the winding sleeves or winding rolls is reached in that, adjacent to and associated with each winding arm, a securing device is guided on the feed rod and is clampable to the feed rod, and that the securing device is coupled, by means of a cylinder unit, acting in the axial direction of the cross-beam, to the corresponding winding arm so that the cylinder unit enables an axial displacement of the winding arms when actuated, thereby enabling a tight clamping of the specific winding sleeve or roll between the winding arms of the pair.

BRIEF DESCRIPTION OF THE DRAWINGS

One embodiment of the winding machine according to the invention will be described in the following with reference to the accompanying drawings, wherein.

DESCRIPTION OF THE PREFERRED EMBODIMENT

Figure 1:
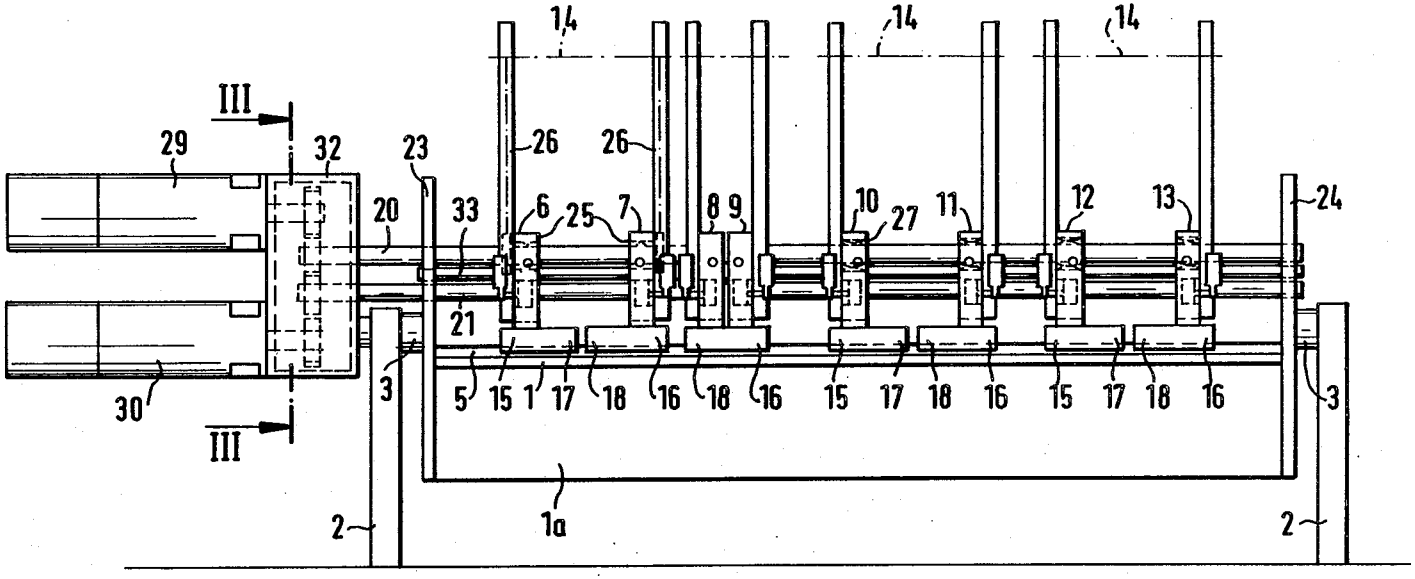
FIG. 1 shows a total view of a winding machine according to the invention.
Figure 3:
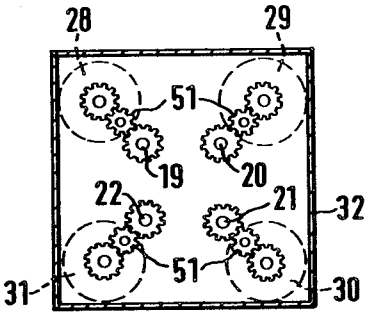
FIG. 3 is a section along line III—III in FIG. 1.
Figure 2:
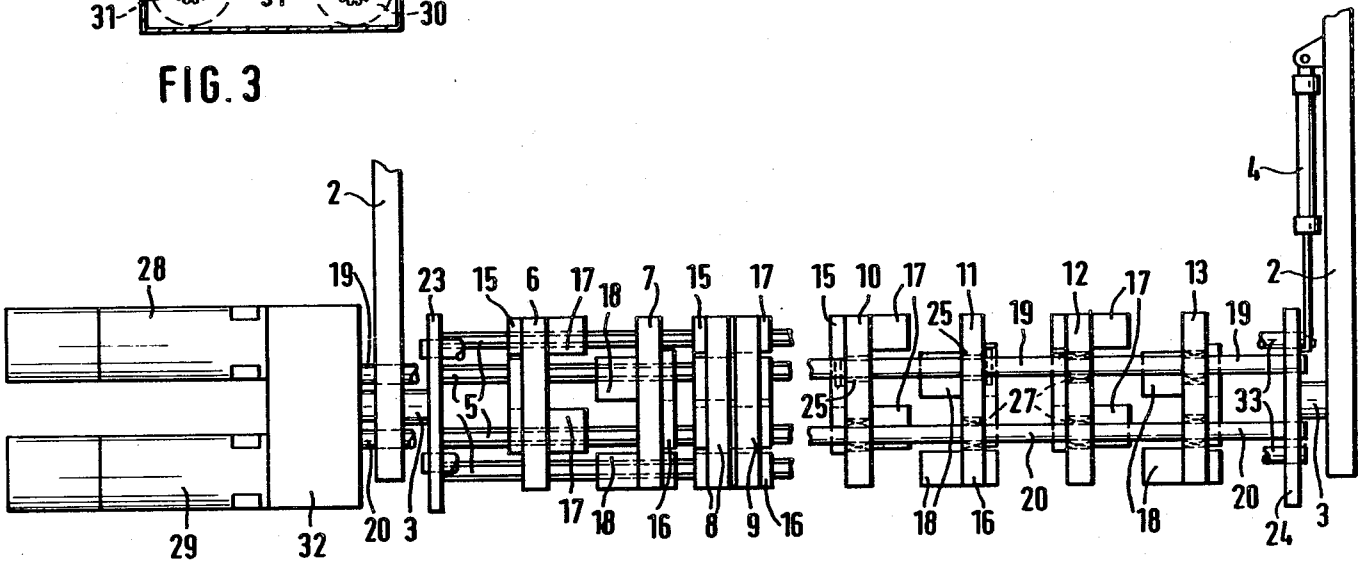
FIG. 2 is a plan view in regard to FIG. 1.
Figure 4:
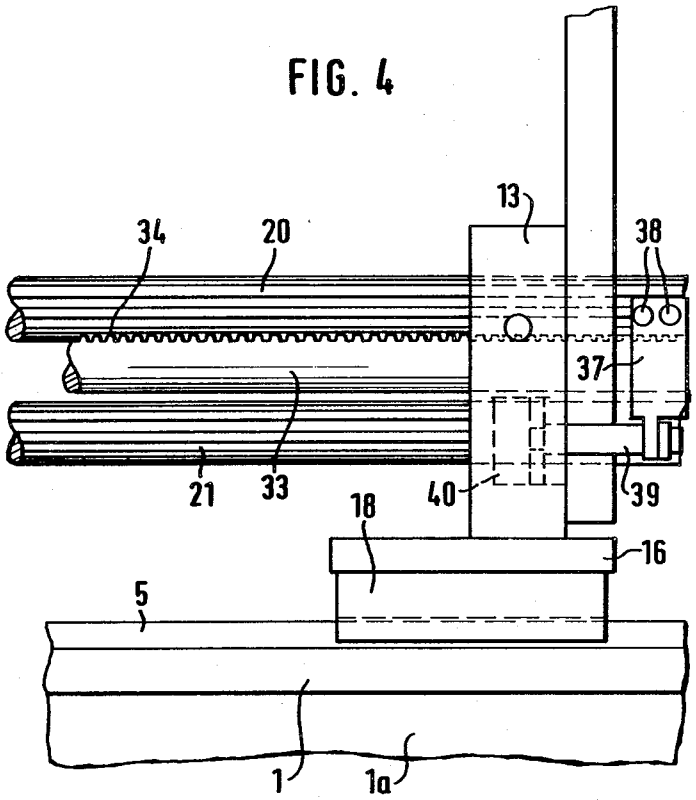
FIG. 4 is an enlarged partial view of the guideways of a traverse with a winding arm, whilst

FIGS. 1 and 2 show a T-shaped cross-beam 1, which is pivotably borne on swivelling bolts 3 between two side frames 2. The cross-beam is a stable, torsion-stiff structure. The swivelling of the cross-beam is effected by means of a swivelling unit 4.

Figure 5:
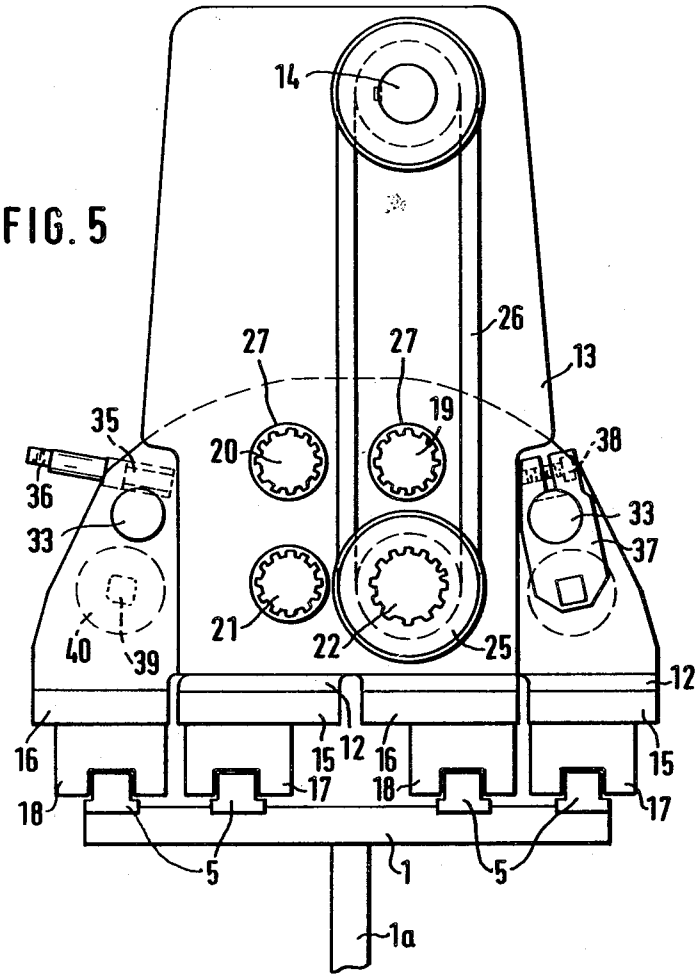
FIG. 5 is a side elevation looking to the left in regard to FIG. 4.

The cross-beam has longitudinally extending guideways 5, on which winding arms 6, 7, 8, 9, 10, 11, 12, 13 are displaceably arranged in pairs in the longitudinal direction of the cross-beam. Each pair of winding arms rotatably receives on a winding axle 14 a winding sleeve or roll driven by a winding drive, that is not shown in detail. FIG. 5 shows a belt 26 and pulley 25 used to impart rotation from the drive shaft 22 to a winding sleeve on axle 14. The pairs of winding arms are adjustable in the longitudinal direction of the cross-beam to a determined winding width. The individual winding webs come from a roll slitting machine. As is known, two, or more, winding machines of the kind described are arranged after a roll slitting machine. Same may be provided symmetrically on both sides of the separating roller of the coil slitting machine, one above the other, or in another spatial arrangement.

Each winding arm is positioned on a guide carriage 15, 16. Each guide carriage has two feet 17, 18; that is particularly evident from FIG. 2. The feet 17, 18 are guided by linear ball guides on the guideways 5. The feet 17 of the specific left guide carriage 15 are offset in regard to the feet 18 of the specific right guide carriage 16, as seen in FIG. 2, so that the feet engage each other in a meshing manner. The feet 17 cooperate with two of the guideways 5, the feet 18 cooperate with the other two guideways 5 so that the right-hand and left-hand guide carriages cooperate in each case with the first and third and with the second and fourth guideway, respectively. By this meshing arrangement in the longitudinal direction of the cross-beam a large guideway length supports each winding arm, in order to take up the necessary winding moments. Nevertheless it is possible that the winding arms move very close together, because the feet 17 and 18 engage each other in a meshing manner. That is shown in FIG. 2 for the winding arms 8 and 9.

Over the entire length of the cross-beam, drive shafts 19, 20, 21, 22 extend, which are arranged in parallel with one another and which have a comparatively small distance between axes. These drive shafts are supported in shield plates 23 and 24 of the cross-beam and extend through all winding arms. The drive shafts 19, 20, 21, 22 are provided as exterior splined shafts. The splined profiles extend over the entire length of the drive shaft. The drive shafts extend in each case through the passages of the windings arms 6 . . . 13. The drive shaft 19 engages an internally splined driving wheel 25 in each winding arm 6 and 7. These driving wheels 25 are coupled with the winding drive 26 for the winding arms 6 and 7. The winding drive imparts rotation to a roll on winding axle 14, a belt and pulley drive being shown in FIG. 5. The drive shaft 19 is guided through the remaining winding arms 8, 9, 10, 11, 12, 13 without a winding drive connection. For the rotation of the drive shaft, bearing elements 27 may be provided in the winding arms for the drive shafts not connected with the winding drive. In the same manner as drive shaft 19, the drive shaft 20 is coupled with the winding drive of the winding arms 8 and 9. The drive shaft 21 is coupled with the winding drive of the winding arms 10 and 11. The drive shaft 22 is coupled with the driving wheels 25 of each winding arm 12 and 13, as is shown in FIG. 5. By this arrangement consequently each winding shaft is coupled in a positive or direct drive manner with the winding drive 26 for one pair of winding arms. The winding arms can be displaced relative to each other for the adjustment to the specific web width in the longitudinal direction of the cross-beam 1, because, on the one hand, the drive shafts, not provided for the drive of the specific winding arm winding drive 26, are freely guided through the winding arms by the bearing elements 27, and because, on the other hand, the driving wheels 25 mate in each case with a drive shaft by the splined interior of the wheels 25 slidably engaging the exterior splined profile of the drive shaft and, thus, the wheels 25 or bearing elements 27 associated with a winding arm can be freely displaced in the longitudinal direction of the cross-beam 1.

The distance between the axes of the drive shafts 19, 20, 21, 22 is as small as possible, in order to keep the space requirements on the cross-beam 1 small. In order to be able to adapt the distance between axes of the drive shafts to the large distance between axes of driving motors 28, 29, 30, 31, a gear box 32 is provided, which comprises the driving wheels 19, 20, 21, 22 as well as the driving wheels of the driving motors 28, 29, 30, 31. Each drive shaft 19, 20, 21, 22 is coupled via a gear train 51 with the specific driving motor 28, 29, 30, 31. Thus, the driving motors 28, 29, 30 31 are arranged in a rectangular configuration and parallel with the drive shafts. The distance between axes of the driving motors is considerably larger than the distance between axes of the drive shafts so that driving motors of the required capacity can be utilized.

The embodiment shows four pairs of winding arms on a cross-beam 1. In the case of an additional number of winding arm pairs it is necessary to utilize a corresponding number of drive shafts together with the specific driving motors. That is possible without difficulties. The coupling as shown in the driving motors to the drive shafts via gear trains may also be effected by other gear mechanisms, e.g. via bevel gears. It is important within the scope of the invention that the driving motors can be attached to the drive shafts while extending out of the working width of the winding cross-beam, and that by the aforesaid coupling of the driving motors to the drive shafts, sufficient space for the utilization of large and powerful driving motors is secured. Thus, it is possible to transmit any high driving power for practical purposes to every pair of winding arm's winding drive. Consequently it is also possible to wind up thick and stiff bands or webs. On the other hand, it is possible to place together very closely the winding arms of a pair for narrow windings, due to the fact that in the space between the winding arms, any space for the driving motors is not required. The drive output of each motor is supplied to a specific drive shaft. Outside the area of the winding cross-beam assembly itself, there is enough wspace to arrange driving motors of practically any number and size. The driving power is positively transmitted so that near negligible friction losses occur. The driving motors may be provided adjacent one end or both ends of the cross-beam. It is important that the driving motors and the gear box are also pivotably borne on the swivelling bolts and are swivelled together with the cross-beam so that within the driving connections between the driving motors and the winding drives distortions cannot occur.

The adjustment of the winding arms 6 . . . 13 in the longitudinal direction of the cross-beam and the securing of the winding arms in their relative positions will be described in the following. Over the entire length of the cross-beam two feed rods 33 extend through each of the winding arms 6–13. The feed rods comprise in each case, extending along the length of the rods, a rack tooth profile 34. A toothed wheel 35 and short shaft with a drive profile 36 is supported for rotation within the specific winding arm. E.g. a drive crank may be attached to the drive profile 36. FIG. 5 shows the details of the feed rod 33 and the toothed wheel 35 for the winding arm 13. By means of rotating this toothed wheel 35 it travels along the rack toothed surface of the feed rods 33 and the specific winding arm can be adjusted in the longitudinal direction of the cross-beam 1. Adjacent to each winding arm, a securing device 37 is provided, which encloses the feed rod 33 in a clamping manner. The securing device 37 can be clamped by means of screws 38 securely to the feed rod 33. The securing device 37 is connected to a piston rod 39 of a cylinder unit 40. The cylinder unit 40 is arranged in the winding arm 13. In this manner it is possible to displace, by actuation of cylinder unit 40, the specific winding arm 13 in regard to its securing device 37. Thereby the two winding arms of a pair can be moved away from each other, in order to exchange the winding core of the specific roll. After insertion of an empty winding core the winding arms of each pair are moved again towards one another so that the empty winding core is clamped on the winding axle 14.

We claim the following:

1. A winding machine comprising: a longitudinally extending cross-beam arranged to pivot about a longitudinal pivoting axis, said cross-beam including longitudinally extending guideways; a plurality of pairs of winding arms positioned on said guideways of said cross-beam for movement along said guideways; said plurality of pairs of winding arms arranged for rotatably supporting a roll to be wound on each of said pairs; a plurality of drive shafts, each associated with a pair of said plurality of pairs of winding arms and aligned in parallel with the pivoting axis of said cross-beam, each of said drive shafts being rotatably supported by at least one of said pairs of winding arms; a plurality of drive means, each associated with a drive shaft and arranged to provide a driving connection between said drive shaft and a pair of said winding arm pairs associated with said drive shaft to rotate a roll supported on the respective pair of winding arms; and a plurality of driving motors, each motor disposed in driving connection with a drive shaft of said plurality of drive shafts, said driving motors mounted at least at one end of the cross beam in fixed relationship longitudinally relative to said cross beam, and longitudinally outside said guideways of said cross beam whereon the winding arms and drive means are located.

2. A winding machine according to claim 1 wherein the driving connection between each of said driving motors and said drive shafts comprises a gear unit.

3. A winding machine according to claim 2, wherein said plurality of driving motors are arranged in a rectangular configuration with their axes parallel with said drive shafts.

4. A winding machine according to claim 3, wherein said plurality of driving motors pivot about said pivoting axis with said cross-beam.

5. A winding machine according to claim 4, wherein each drive shaft has exterior splines extending along its length, and said associated drive means comprises a driving wheel with an interior splined passage engaged with and rotatably fixed to said exterior splined drive shaft.

6. A winding machine according to claim 5, wherein said drive shafts are rotatably supported by said pairs of winding arms by bearings rotatably fixed to said drive shafts.

7. A winding machine according to claim 6, wherein four guideways are arranged on said cross-beam, and that each winding arm of a pair comprises a pair of feet, said pair of feet of one winding arm are staggered in relation to said pair of feet of the other winding arm of said pair of winding arms, and said pairs of feet engage each other in a meshing manner, each of said pair of feet being guided on two guideways.

8. A winding machine according to claim 7, wherein rods having a rack tooth profile extend over the entire length of said cross-beam and through each of said winding arms; and each of said winding arms rotatably supports a short shaft having a toothed wheel at one end in meshing engagement with said rack tooth profile, and a second end which extends from said winding arm, so that rotation of said short shaft causes movement of said winding arm along said guideways.

9. A winding machine according to claim 8, wherein each winding arm comprises a securing device guided on said feed rod and capable of being secured to said feed rod, and that said securing device is coupled, by means of a cylinder and piston unit acting in the axial direction of said cross-beam, to said associated winding arm, where said cylinder is fixed to said winding arm and said piston is fixed to said securing device so that said cylinder and piston unit enables an axial displacement of said associated winding arm when actuated, thereby enabling a tight clamping of said roll received by said pair of winding arms.

* * * * *